United States Patent [19]

Gergely, Jr. et al.

[11] Patent Number: 5,060,838

[45] Date of Patent: Oct. 29, 1991

[54] CLAM SHELL HOUSING FOR DUAL WEB BURSTING APPARATUS

[75] Inventors: William Gergely, Jr., Monroe; Karel J. Janatka, Southbury, both of Conn.

[73] Assignee: Pitney Bowes Inc., Stamford, Conn.

[21] Appl. No.: 619,536

[22] Filed: Nov. 29, 1990

[51] Int. Cl.[5] ..... B65H 35/10

[52] U.S. Cl. ..... 225/100; 225/97

[58] Field of Search ..... 225/98, 99, 100, 106, 225/97

[56] References Cited

U.S. PATENT DOCUMENTS

| | | | |
|---|---|---|---|
| 2,258,428 | 10/1941 | Stalder | 225/99 |
| 2,649,156 | 8/1953 | Stafford | 225/100 |
| 4,454,973 | 6/1984 | Irvine | 225/100 |
| 4,524,557 | 6/1985 | Silverman et al. | 53/55 |
| 4,570,923 | 2/1986 | Hooper et al. | 271/275 |
| 4,618,085 | 10/1986 | Kimura et al. | 225/100 |
| 4,619,101 | 10/1986 | Havey et al. | 53/117 |
| 4,690,344 | 9/1987 | Yokota | 242/55.53 |

FOREIGN PATENT DOCUMENTS 157309 12/1904 Fed. Rep. of Germany ..... 225/100

*Primary Examiner*—Frank T. Yost
*Assistant Examiner*—John M. Husar
*Attorney, Agent, or Firm*—Charles R. Malandra, Jr.; David E. Pitchenik; Melvin J. Scolnick

[57] ABSTRACT

Apparatus for conveying upper and lower webs of material having equally spaced, successive, transverse lines of weakening along a longitudinal path and for separating the webs along the transverse lines of weakening. The apparatus includes: a longitudinally extending support structure; a bottom pair of upper and lower, vertically spaced feed rollers rotatably supported by the structure; a pair of upper and lower, vertically spaced burster rollers, the lower burster roller having a shaft and being rotatably supported by the structure downstream of the bottom feed rollers; a clam shell housing pivotably mounted on the lower burster roller shaft, wherein the upper burster roller is supported by the clam shell housing; and a top pair of upper and lower, vertically spaced feed rollers rotatably supported by the clam shell housing.

4 Claims, 5 Drawing Sheets

28
28
36
38
26
26
20
22
24
24
44
44

26
10
12
30
34
14
36
32
38
16

CLAM SHELL HOUSING FOR DUAL WEB BURSTING APPARATUS

BACKGROUND OF THE INVENTION

The instant invention relates to bursting apparatus and more particularly to a clam shell housing for apparatus for bursting continuous webs of material along transverse lines of weakening.

Business forms are often preprinted on a continuous web of perforated material. Such forms are conventionally used in billing and other typical business transactions. The continuous series of forms require processing for end use, such as mailing, which may require bursting or separating the forms, as well as the performance of the end functions of stacking, stamping, sealing, inserting, collating (for additional enclosures) and folding. The aforesaid end functions are all provided for with existing equipment in one continuous process.

The bursting of the web is typically achieved with the use of two sets or pairs of rollers. The downstream rollers are made and arranged to be driven at a slightly higher speed than the upstream rollers, so that the web, when properly perforated, will separate. There is an additional element called a burst ball or burster roller located between the two pairs of rollers which assists the separation process, especially if the two rollers are running at the same speed and the upstream rollers are momentarily stopped to permit the downstream rollers to continue feeding the desired, separated sheet.

In the interest of greater efficiency and throughput, attempts have been made to feed two webs through a single pair of upstream (feeding) rollers so that two webs could be handled and burst alternately. The webs were offset by half a pitch or length of sheet being burst. The mechanical arrangement was as described hereinabove regarding rollers and the bursting element. The result was that the web lying in contact with the upper feed (upstream) roller, i.e. the upper web, would creep out of position due to the geometric relationship of the web in bending about the feed roller at the entry area. This creep results in the perforation on the upper web not being in the correct position when that web arrived at the bursting roller, which prevents the upper web from bursting properly at the correct time.

There have been several attempts to eliminate the creep problem, one of which requires an additional pair of feed rollers, so that two paper paths are created, one for each web. Obviously, for purposes of loading the web into the bursting apparatus and for clearing jams, the upper paper path poses no additional problems. However, the lower paper path, being beneath the upper paper path, does pose problems when it comes to loading the bursting apparatus for operation and when a jam occurs in the lower paper path. Prior art bursting devices which operate with dual web paths provide access for these purposes to the lower web only through the upper paper path or around other parts, which makes access for loading and jam clearance extremely difficult.

Accordingly, the instant invention provides a clam shell housing which permits the upper paper path to be pivoted away from the lower paper path, thereby providing complete access to the lower paper path without any interference from the upper paper path.

SUMMARY OF THE INVENTION

The instant invention thus provides apparatus for conveying upper and lower webs of material having equally spaced, successive, transverse lines of weakening along a longitudinal path and for separating the webs along the transverse lines of weakening. The apparatus includes: a longitudinally extending support structure; a bottom pair of upper and lower, vertically spaced feed rollers rotatably supported by the structure; a pair of upper and lower, vertically spaced burster rollers, the lower burster roller having a shaft and being rotatably supported by the structure downstream of the bottom feed rollers; a clam shell housing pivotably mounted on the lower burster roller shaft, wherein the upper burster roller is supported by the clam shell housing; and a top pair of upper and lower, vertically spaced feed rollers rotatably supported by the clam shell housing.

DETAILED DESCRIPTION OF THE PREFERRED EMBODIMENT

Figure 1:
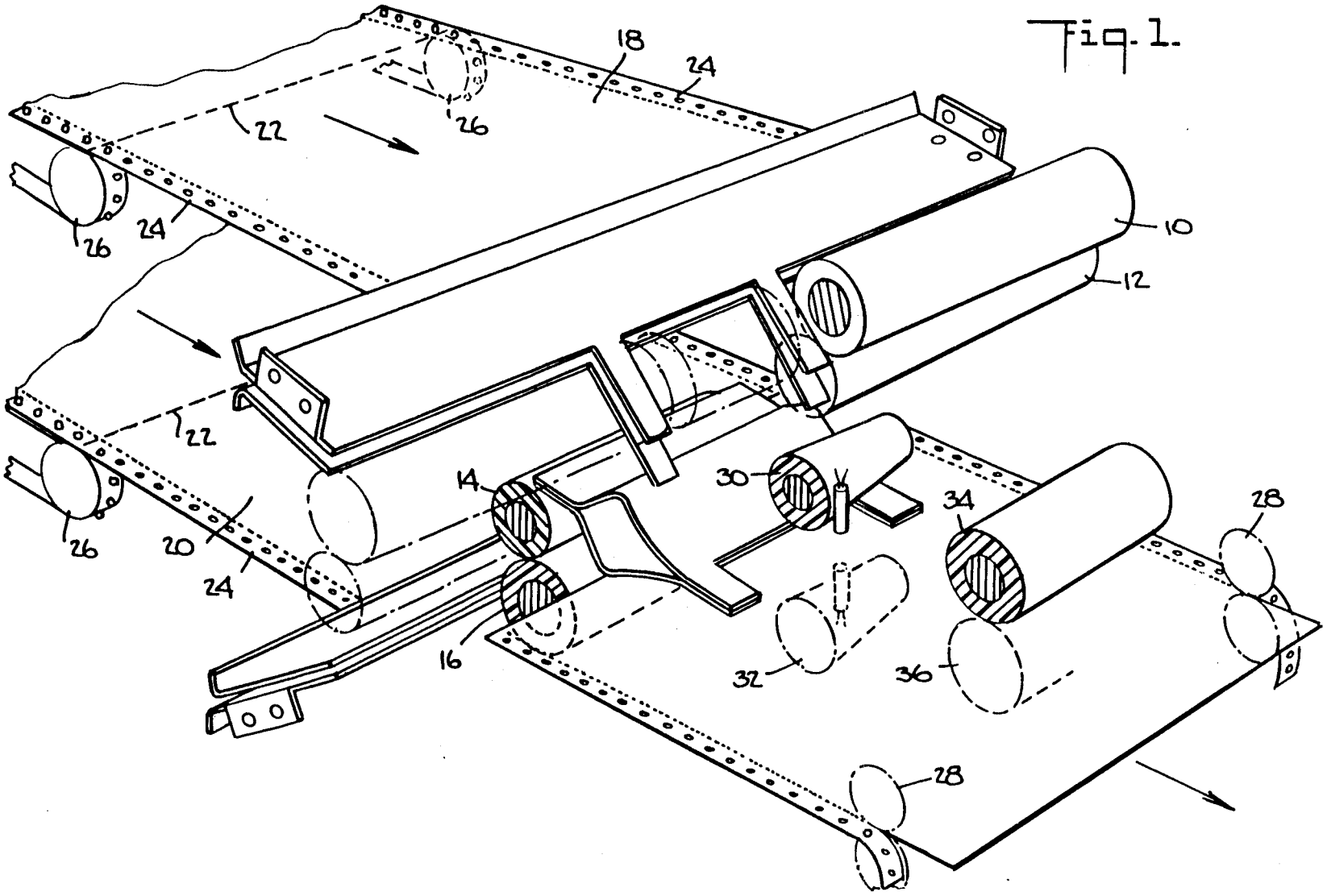
FIG. 1 is a perspective view of bursting apparatus for two webs utilized in the instant invention without the housing structure.
Figure 2:
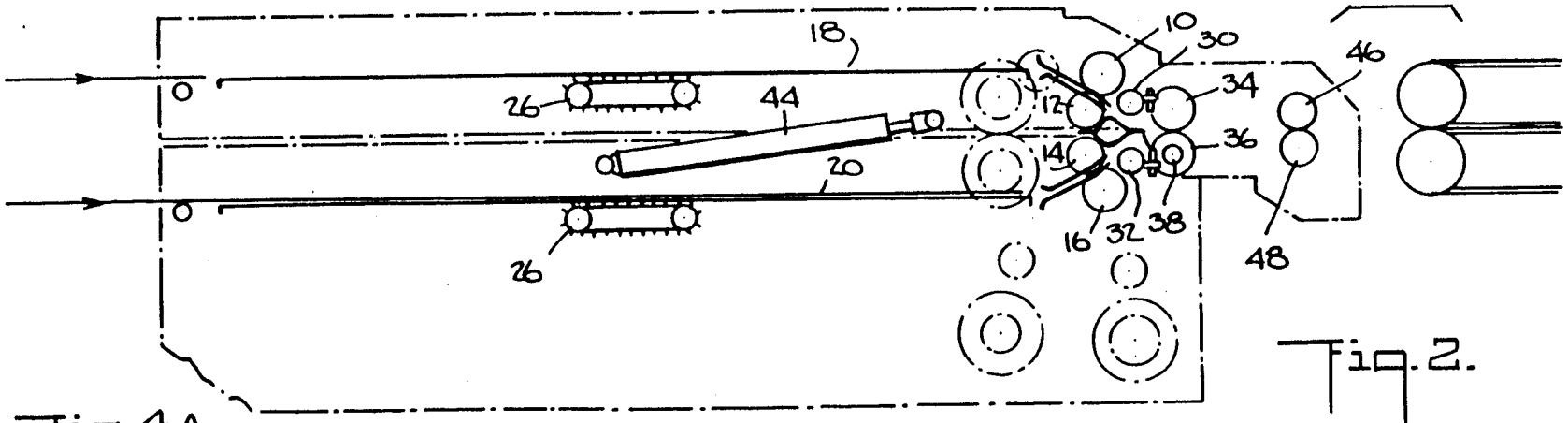
FIG. 2 is a side, elevational view of the bursting apparatus seen in FIG. 1 supported by a clam shell housing in accordance with the instant invention.

In describing the preferred embodiment of the instant invention, reference is made to the drawings, wherein there is seen bursting apparatus including a pair of stepper motor driven, upper, feed rollers lo and 12 and a pair of stepper motor driven, lower, feed rollers 14 and 16 for feeding an upper web 18 and a lower web 20 of computer printout paper having transverse lines of weakening 22 defining separate sheets. The webs 18 and 20 initially include sprocket strips 24 on either side (see FIG. 1) which are engaged by pairs of adjustable, eight pin needle bearing tractors 26 which feed the webs 18 and 20 to the pairs of feed rollers 10 and 12 and 14 and 16 respectively. Situated downstream of the pairs of feed rollers 10 and 12 and 14 and 16 are upper and lower, adjustable bursting cones 30 and 32. Downstream of the bursting cones 30 and 32 is a pair of stepper motor driven bursting rollers 34 and 36. Downstream of the bursting rollers 34 and 36 are a pair of D.C. motor driven, sprocket strip trimmer 28 for removing the sprocket strips 24 from the webs 18 and 20. It can be seen that the two paper paths defined by the two pairs of feed rollers 10 and 12 and 14 and 16 converge into one paper path at the bursting rollers 34 and 36.

Figure 3:
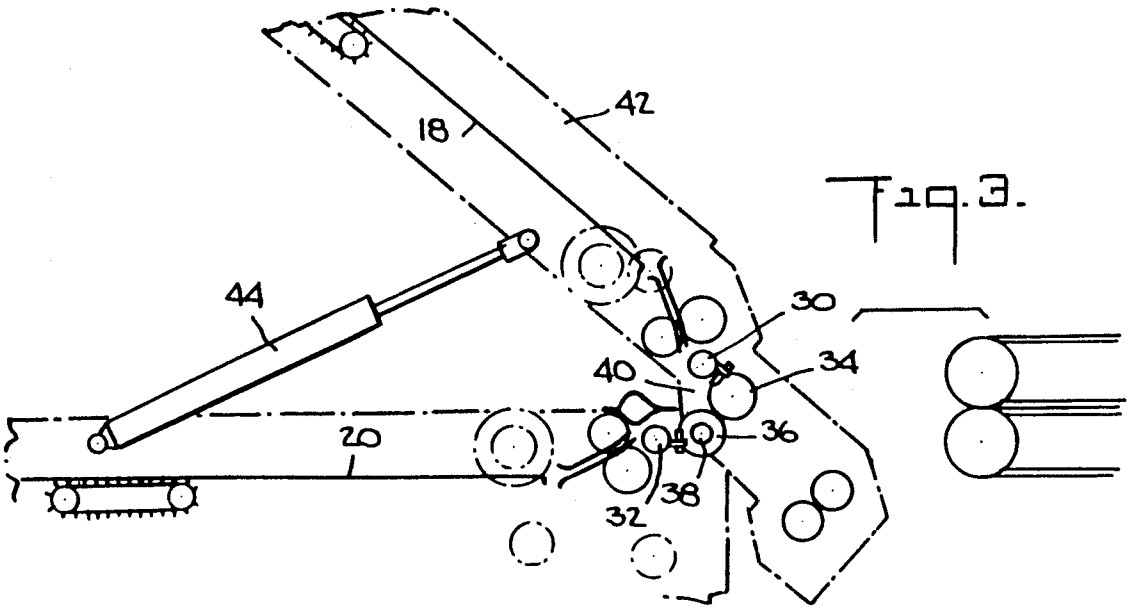
FIG. 3 is the same as FIG. 2 but the claim shell housing is shown in the open position.
Figure 7:
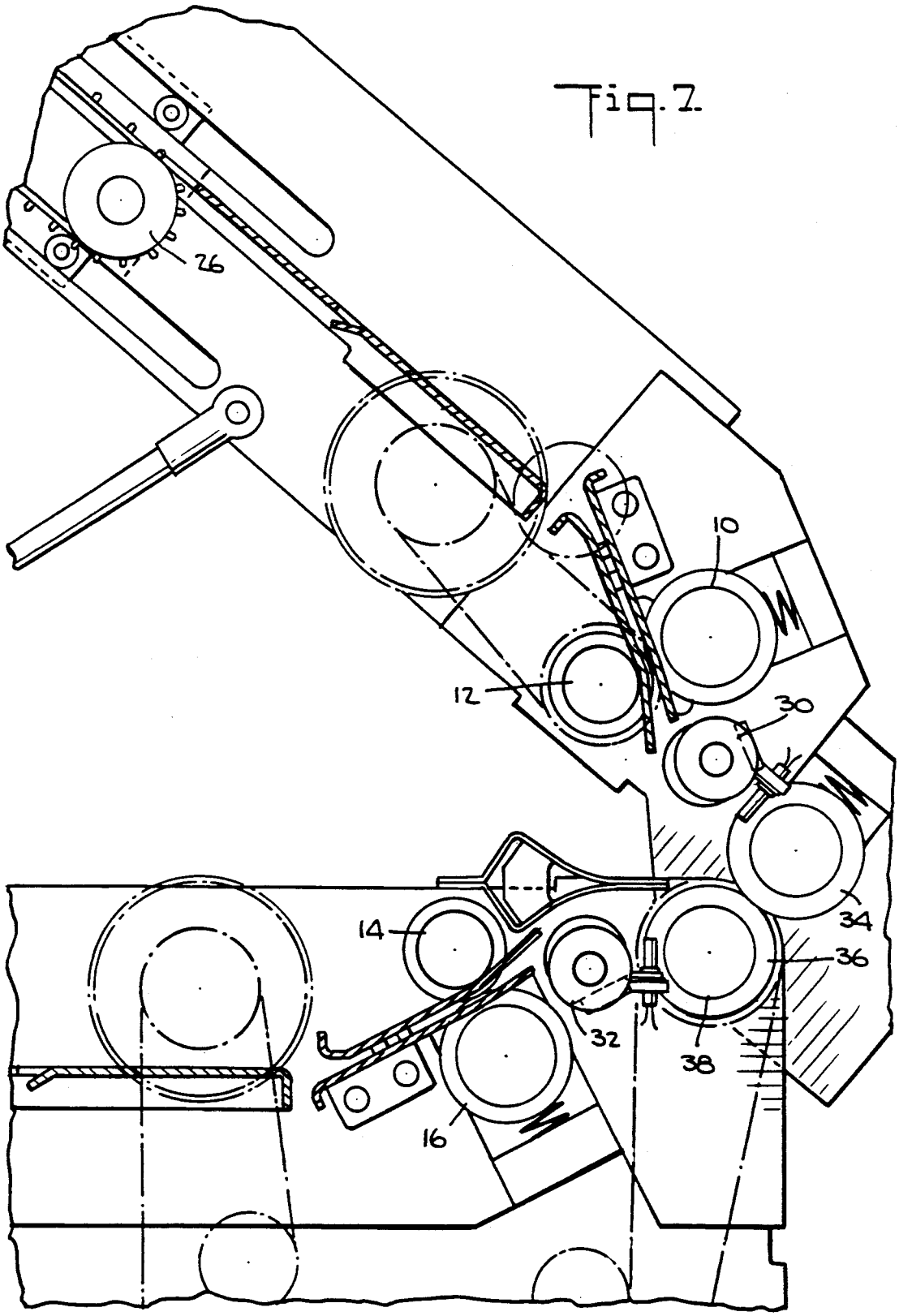
FIG. 7 is the same as FIG. 6 except the clam shell housing is in the open position.

The lower bursting roller 36 is mounted on a shaft 38 on which are mounted a pair of yokes 40 which support the upper, clam-shell housing 42 for the aforesaid bursting apparatus. As best seen in FIGS. 3 and 7, the clam-shell housing 42 supports the upper burst roller 36, the upper pair of feed rollers 10 and 12, the upper web 18, and the upper bursting cone 30. The open construction of the clam-shell housing 42 provides ready access at all times to the upper web 18, and by virtue of its ability to pivot open as seen in FIG. 3, access is provided to the lower web 20. A gas spring 44, available commercially, maintains the clam-shell housing 42 in the open position so that jams can be cleared, or other problems involving the lower web 20 addressed. Downstream of the bursting rollers 34 and 36 is a pair of transport rollers 46 and 48 for transporting the separated sheets downstream for further processing.

Figure 4A:
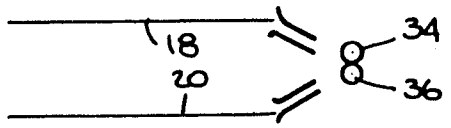
FIG. 4A is a schematic, side, elevational view of the paper paths and bursting rollers.
Figure 4B:
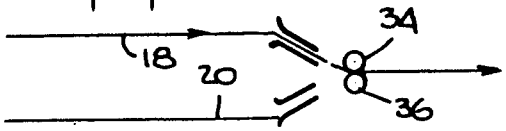
FIG. 4B is similar to FIG. 4A except that the top web is shown being burst.
Figure 4C:
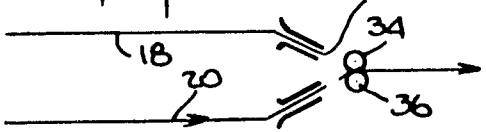
FIG. 4C is similar to FIG. 4B except that the bottom web is shown being burst.
Figure 5:
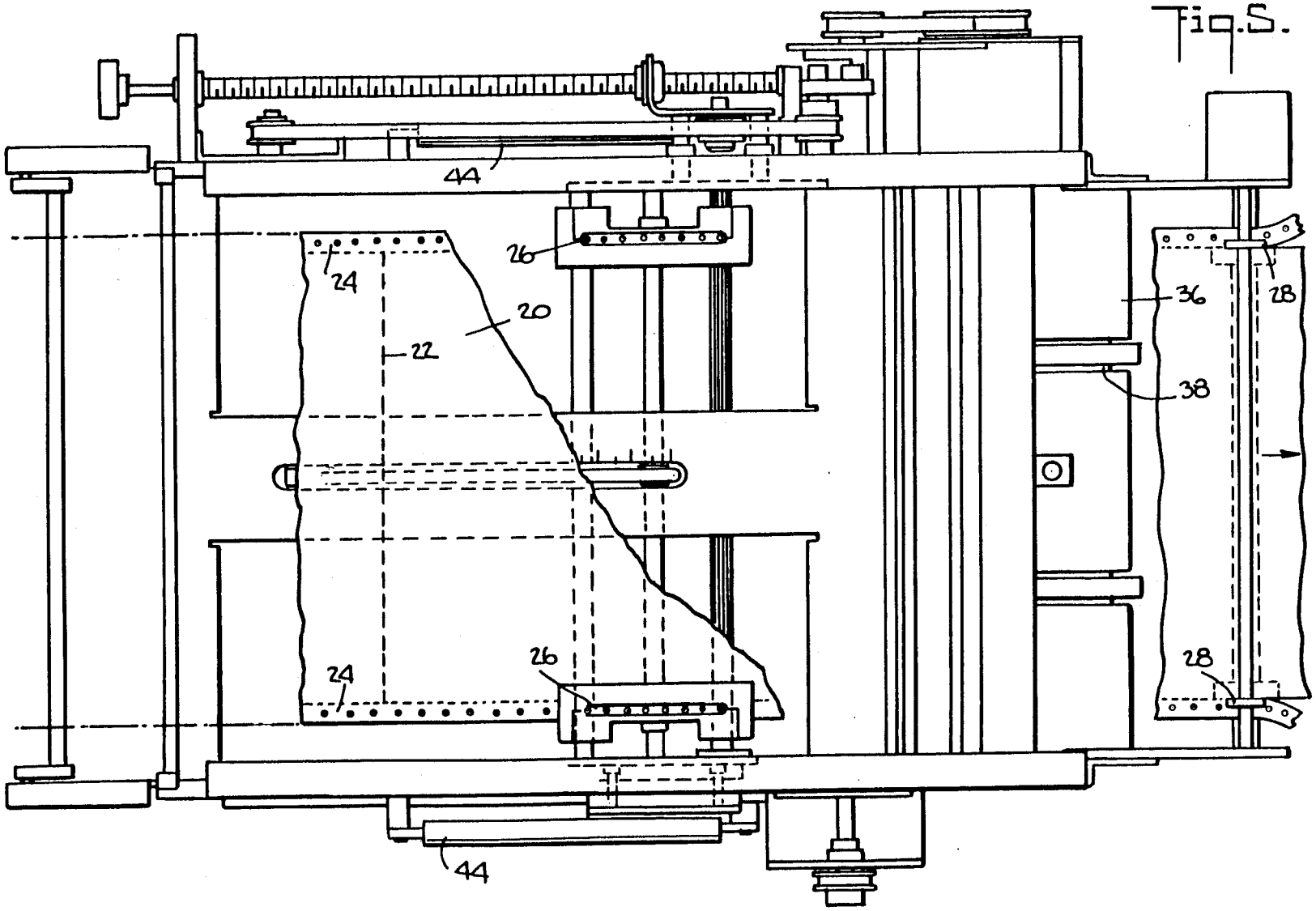
FIG. 5 is a top, plan view of the apparatus seen in FIG. 1.
Figure 6:
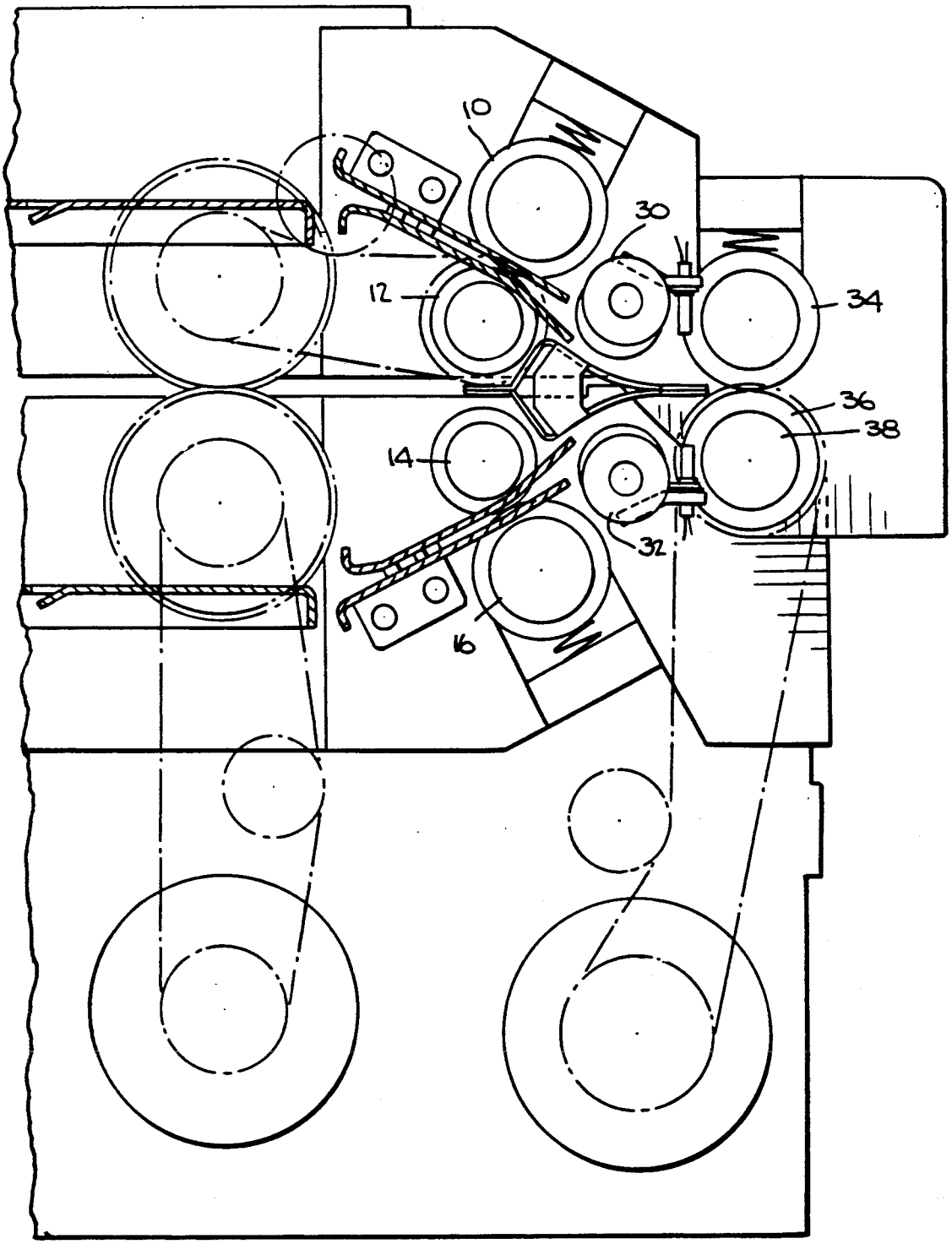
FIG. 6 is an enlarged, side, elevational view of the burster rollers and clam shell housing in the closed position.

As seen in FIG. 4B, the lower web 20 has been burst and the upper web 18 is about to be burst. After the upper web 18 is burst, the bottom web 20 is about to be burst, as seen in FIG. 4C, and after the bottom web 20 is burst, the two webs 18 and 20 continue to be burst alternatively.

The steps required to operate the apparatus include determining the length of each discrete sheet in the webs 18 and 20 (each paper path) by a strip length gauge having numerical increments representing varying sheet lengths. This number is now used to position the tractors 26 to a numerically equivalent gauge setting on the paper path deck(s) to a position such that the first sheet will be completely scanned and the lead edge of this sheet will advance, when the apparatus is energized to a position coincident with the center of the burst rollers 34 and 36. This number is also entered by the operator into a pulse counting device(s) (thumbwheels) for each paper path prior to the operation of the apparatus. The feed rollers for each paper path can be driven intermittently or continuously, dependent on whether a collated set or one sheet from each paper path is programmed. Upstream from the burst cones 30 and 32 but downstream from the feed rollers 10, 12, 14 and 16 is positioned a sensing device that detects the leading edge of a sheet from either paper path and sends an appropriate signal to a pulse generator connected to the burst rollers 34 and 36. By means of the pulse counting device(s) previously set by the operator and coincident with the leading edge of the sheet being sensed, a pulse count is reached that accelerates the burst rollers 34 and 36 at the appropriate time and duration to a speed that effectively bursts the sheet as the rollers convey the sheet away from the webs 18 and/or 20. Prior to accelerating, the burst rollers 34 and 36, driven by a separate stepper motor, are rotating at the same speed as the upper or lower feed rollers and tractor/scanner carriage assemblies each of which are mechanically coupled, synchronized and driven by stepper motors. On exiting the burst rollers 34 and 36, the leading edge of the untrimmed sheet will enter the trimmers 28 which were manually positioned to trim off the sprocket strips which exit in downward direction while the trimmed and burst sheet proceeds to the next downstream device.

This cycle is repeated continuously with no stopping or delaying of the feed or burst rollers on any one up (single web) application of collated sets and will stop only when an end of collation is detected by the scanning device or when the sense device does not see a gap between sheets which would indicate a stream feed (unburst sheet) condition.

Because there is a manually settable pulse counting device for each paper path it is possible to feed and burst two different length sheets, that is, one web of continuous strip of one length in the upper paper path and a continuous strip of a different length in the lower paper path but of the same width in each path.

This bursting machine can also be used in nonintelligent (no scanning) applications requiring one sheet per cycle.

It should be understood by those skilled in the art that various modifications may be made in the present invention without departing from the spirit and scope thereof, as described in the specification and defined in the appended claims.

What is claimed is:

1. Apparatus for conveying upper and lower webs of material having equally spaced, successive, transverse lines of weakening along a longitudinal path and for separating said webs along said transverse lines of weakening, comprising:

a longitudinally extending support structure;

a bottom pair of upper and lower, vertically spaced feed rollers rotatably supported by said structure;

a pair of upper and lower, vertically spaced burster rollers, said lower burster roller having a shaft and being rotatably supported by said structure downstream of said bottom feed rollers;

a clam shell housing pivotably mounted on said lower burster roller shaft, wherein said upper burster roller is supported by said clam shell housing; and a top pair of upper and lower, vertically spaced feed rollers rotatably supported by said clam shell housing.

2. The apparatus of claim 1, wherein the clam shell housing is pivotably mounted on said lower burster roller shaft with a pair of yokes.

3. The apparatus of claim 2, additionally comprising an upper and a lower bursting cone downstream of said feed rollers and upstream of said bursting rollers, said upper bursting cone supported by said clam shell housing and said lower bursting cone supported by said longitudinally extending support structure.

4. The apparatus of claim 4, additionally comprising a spring for maintaining the clam shell housing in an open position to thereby provides access to the lower web.

* * * * *